US006682309B2

(12) United States Patent
Reid

(10) Patent No.: US 6,682,309 B2
(45) Date of Patent: Jan. 27, 2004

(54) SUBMERSIBLE PUMP SYSTEM

(76) Inventor: John A. Reid, 62 Linvale Rd., Ringoes, NJ (US) 08551

( * ) Notice: Subject to any disclaimer, the term of this patent is extended or adjusted under 35 U.S.C. 154(b) by 0 days.

(21) Appl. No.: 10/054,321

(22) Filed: Jan. 22, 2002

(65) Prior Publication Data

US 2003/0138326 A1 Jul. 24, 2003

(51) Int. Cl.[7] ..... F04B 49/025

(52) U.S. Cl. ..... 417/36; 417/423.15; 417/40; 417/360; 417/423.14; 417/423.3

(58) Field of Search ..... 417/423.3, 423.65, 417/423.9, 423.14, 424.1, 43 J, 36, 40, 211.5, 360

(56) References Cited

U.S. PATENT DOCUMENTS

| | | | | | |
|---|---|---|---|---|---|
| 4,218,195 | A | * | 8/1980 | Shure | 417/411 |
| 4,693,271 | A | | 9/1987 | Hargrove et al. | 137/565 |
| 5,147,149 | A | * | 9/1992 | Craig et al. | 405/223.1 |
| 5,203,682 | A | | 4/1993 | Inklebarger | 417/435 |
| 5,207,273 | A | * | 5/1993 | Cates et al. | 166/369 |
| 5,490,419 | A | | 2/1996 | Webb | 73/40.5 |
| 5,538,396 | A | * | 7/1996 | Meierhoefer | 417/19 |
| 5,667,362 | A | * | 9/1997 | Murai et al. | 417/41 |
| 6,050,050 | A | | 4/2000 | Daul et al. | 52/741.12 |
| 6,065,946 | A | * | 5/2000 | Lathrop | 417/423.14 |
| 6,126,409 | A | | 10/2000 | Young | 417/297 |
| 6,129,529 | A | * | 10/2000 | Young et al. | 417/423.3 |
| 6,152,707 | A | * | 11/2000 | Alberg | 417/423.3 |
| 6,174,146 | B1 | * | 1/2001 | Lacy et al. | 417/423.15 |
| 6,315,526 | B1 | * | 11/2001 | Jones | 417/363 |

* cited by examiner

*Primary Examiner*—Justine R. Yu
*Assistant Examiner*—Emmanuel Sayoc
(74) *Attorney, Agent, or Firm*—Kenneth P. Glynn, Esq.; Deirdra M. Meagher, Esq.

(57) ABSTRACT

The present invention is a submersible pump system that includes a main housing, which is watertight and contains a submersible pump therein. There is a liquid suction inlet connected to the main housing and adapted for functional connection to a liquid source. This may be a direct pipe connection, or an open intake. There is also a one way check valve functionally connected to the main housing and located downstream from the liquid suction inlet, adapted to permit liquid to flow from the inlet to the main housing and to prevent liquid from oppositely flowing. The submersible pump has electrical power wiring and control wiring connected thereto and extending out of the main housing with a watertight seal. The pump has a submersible pump inlet to pump liquid from the main housing, and a pump outlet directly connected to a liquid flow outlet extending out through the main housing for liquid distribution therefrom. When the pump is turned on, the liquid in the main housing is removed, creating negative pressure which draws water into the housing from the connected source which may be below the pump system.

16 Claims, 3 Drawing Sheets

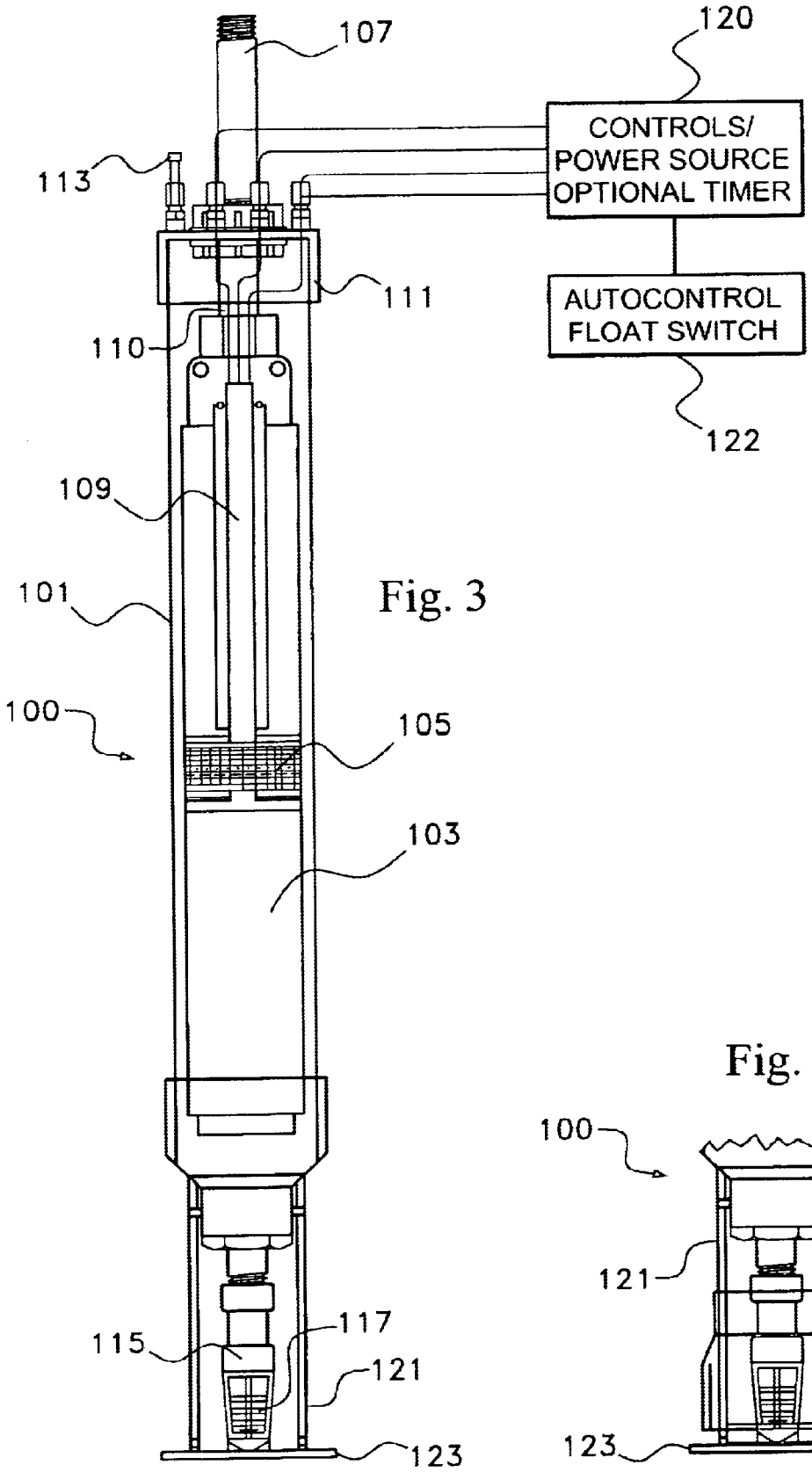
Fig. 3
Fig. 4
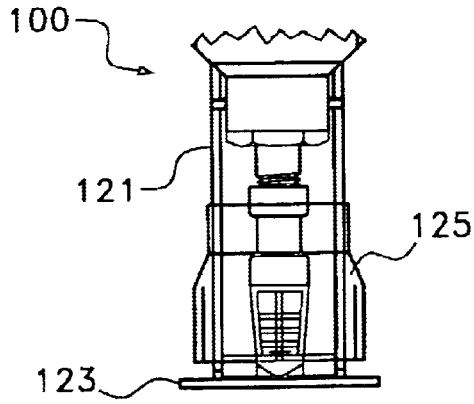

SUBMERSIBLE PUMP SYSTEM

BACKGROUND OF THE INVENTION

1. Field of the Invention

The present invention relates to submersible pumps, and more particularly, specific submersible pump systems which enable the submersible pumps to be used in situations otherwise heretofore not possible. The present invention system is a fully self-contained watertight chamber which enables a user to utilize the submersible pump to pump out lower levels of liquid than previously possible, to operate above ground, above water level or below, to operate at atmospheric pressure, and to even operate on "city water" systems to enhance water pressure and/or to provide desired flow rates above otherwise available flow rates.

2. Information Disclosure Statement

The following patents are representative of the prior art relating to pumps and pump systems:

U.S. Pat. No. 6,126,409 describes a manifold assembly that includes a housing unit, which has a valve assembly and a pressure relief valve assembly formed in one integral unit. When the check valve is in a closed position, the dispensing line is sealed off from the pumping assembly. In addition, the check valve also seals off the pressure relief outlet in the same movement, by the use of two O-rings placed on a lockdown member. Line maintenance tests may be performed accurately, as well as testing of the pumping assembly, when the check valve and pressure relief valve are closed. This structure provides an improved assembly since the check valve and pressure relief valve are formed in one integral unit so as to be adjacent one another so that both valves can be conveniently closed off at the same time during a maintenance check.

U.S. Pat. No. 6,050,050 describes a method of upgrading an existing unprotected submersible pump area with secondary containment to prevent accidental release of harmful materials from contaminating the soil below grade.

U.S. Pat. No. 5,667,362 describes a pump system comprising a pump having a centrifugal impeller driven by an electric motor, a pair of upper and lower float switches for detecting a high water level, HWL, and a low water level, LWL, respectively, a controller for outputting a control signal on the basis of preset rotational speed for low and high-speed operations and a preset rational speed increment rate, together with output signals from the upper and lower float switches, and a frequency converter for varying the rotational speed of the electric motor on the basis of the of the control signal from the controller, the pump system is capable of exhibiting the required pumping performance and of controlling the flow rate and the pump head.

U.S. Pat. No. 5,538,396 describes a hydraulic pressure booster device suited for increasing in-line fluid pressures comprising the assembly of a vertically oriented, tubular, closed end, housing for a submersible fluid pump. The pump is secured to a cap flange which closes the top of the tubular housing, while the bottom of the tubular housing is closed with either an anchor plate or blind end cap. Compression seal fittings are used to seal the penetration of pump motor pump lead wires through the cap flange. Inlet flow received into the tubular housing is drawn through the submersible pump with a resultant increase in hydraulic pressure at the output. A housing pressure sensing switch interrupts pump operation to prevent pump damage during periods of low fluid level in the housing. Additional pump protection is provided via a pump outlet pressure monitoring switch which regulates the pump delivery pressure. Dimensional design features of the device enhance useability and maintainability.

U.S. Pat. No. 5,490,419 describes a sump-riser performing as a collection sump, as a riser for the corresponding tank and as a mean for secondary containment for the tank's submersible pump, manway, and fittings. The sump-riser comprises a generally cylindrical sump base with an upright annular lip extending upwardly from an upper support surface; an extension riser including a lower annular riser lip which fits over and round the lip of the sump base; a cover for the extension riser; and an access or observation lid. The riser extension is detachable or removable from the sump base and may be inverted and inserted into the sump base and may be inverted and inserted into the sump base for compact shipping. Score lines may be provided on the riser extension to serve as cutting guides for proper sizing and the sump base may be multi-sided to provide flat walls for accurate hole drilling for pipe and conduit entry.

U.S. Pat. No. 5,203,682 describes a submersible pump assembly mounted within a pressure vessel or jacket for use at the surface for an injection well. The jacket has an inlet which connects to a feed pump for supplying feed water under pressure. The motor, seal section and pump mount within the jacket, with a discharge conduit extending out a discharge end of the jacket. The support for the jacket inclines the jacket at an inclination relative to horizontal. This causes any gases in the feed water to migrate toward and accumulate at the upper end of the jacket. A bleed off valve is employed to bleed off the accumulation of gases.

U.S. Pat. No. 4,693,271 describes a horizontally mounted submersible pump assembly for pumping water from the water storage tanks, which pump assembly is characterized by a submersible pump mounted inside a horizontally oriented tube extending through the wall of a water storage tank. A valve is provided in cooperation with the immersed end of the tube to facilitate flow of water into the tube to the pump and the opposite, dry end of the tube is closed by an adapter flange mounted on a length of adapter pipe, one end of which extends into the tube and communicates with the discharge of the pump and the other end of which is flanged to a water distribution line. The water distribution line extends to a conventional pressure tank for distributing water to multiple users on demand. The submersible pump is typically of turbine design and is sized to quickly and efficiently pressurize the water distribution system by pumping water from the storage tank and the flooded tube to the pressure tank. The tube enclosing the pump facilitates removal and replacement of the pump from the dry end of the tube without draining the storage tank.

Notwithstanding the prior art, the present invention is neither taught nor rendered obvious thereby.

SUMMARY OF THE INVENTION

The present invention relates to a submersible pump system for providing a self-contained watertight chamber for a pump. It may uniquely be utilized for a number of different types of pumping needs that could not heretofore be accomplished with submersible pumps. These applications include, but are not limited to, open pond and puddle pumping, enclosure pumping, direct pumping, from a well, auxiliary pumping from a well system and direct pumping form a "city water" supply, even when incoming water pressure is at or below atmosphere pressure.

The system includes a main housing, which is watertight and adapted to contain a submersible pump therein. This main housing is adapted to receive the submersible pump in a non-horizontal position and to hold water therein to maintain a predetermined water level around the submersible pump, even when the pump is pumping from very shallow external liquid sources. Because of the unique arrangement in the present invention system, the need to maintain a head of pressure on the liquid inside the main housing is eliminated and there is no need to have the water source at a level above the pump inlet. When the submersible pump is activated, a negative pressure is created as the content of the chamber is evacuated. This negative pressure is transmitted to the liquid below the pump chamber through the chamber inlet lifting the liquid into the pump chamber.

The present invention system also includes a liquid flow inlet for functional connection to a liquid source. This liquid flow inlet is functionally connected to the main housing upstream from it. There is an in-line one way check valve functionally connected to the main housing and located downstream from the liquid flow inlet. This one way check valve is positioned so as to permit liquid to flow from the inlet to said housing and to prevent liquid from flowing from the main housing to the inlet, that is, to prevent backflow.

A submersible pump is contained within the main housing downstream from the one way check valve in a non-horizontal position, and has electrical wiring and control wiring connected thereto and extending out of the main housing with a watertight seal. The submersible pump inlet located within said main housing and adapted to pump liquid from the main housing. A liquid flow outlet is connected to the submersible pump and extends out through the main housing for liquid distribution therefrom. It is preferred that the pump be positioned such that its inlet is located below the outlet, and that the inlet of the pump, and the pump outlet establish an angle of at least 15 degrees from horizontal, and most preferably at least 20 degrees from the horizon to optimize pump efficiency, to maximize motor thrust baring life and to bring the inlet to a very low position for maximum effectiveness in very shallow liquid bodies.

Thus, the main housing is adapted to receive water intake through the liquid flow inlet, maintain a predetermined water level within the main housing above the submersible pump inlet and provide liquid to the submersible pump inlet, and wherein the liquid flow outlet provides liquid flow from the submersible pump to a location exterior of the main housing directly from the submersible pump.

The submersible pump system main housing preferably includes an air bleeder valve to permit air to bleed from the main housing when it is being filled with liquid.

In some embodiments of the present invention, an automatic control float switch, or level sensor, may be utilized to turn the pump on and off as water level in a reservoir rises and falls.

The submersible pump system may be self-standing, but is less vibrational and less prone to movement and/or pipe damage, if secured. Thus, it is preferred that the main housing contain at least one support member connected thereto for attachment to a fixed structure, such as a wall, floor, mounting boards or the like.

The submersible pump system main housing and the components contained therein are arranged in a non-horizontal position, and preferably in a substantially vertical manner, meaning, with one way check valve located above the liquid flow inlet, the submersible pump located above the one way check valve, and the liquid flow outlet located above the submersible pump.

For convenience, the submersible pump system main housing may include a removable watertight top of sufficient size to permit removal and insertion of the submersible pump. This allows for eventual on sight pump or wiring repair replacement. For ease of installation in some embodiments, the submersible pump system may be built wherein the liquid flow inlet is connected to an upstream couplet for connection to a water supply pipe.

In some embodiments of the present invention, there is a shut off valve located between the liquid flow inlet and the one way check valve. It may further include at least one control mechanism for controlling the submersible pump that is located downstream from the main housing, e.g., a pressure switch.

BRIEF DESCRIPTION OF THE DRAWINGS

The present invention should be more fully understood when the specification herein is taken in conjunction with the drawings appended hereto wherein:

FIG. 3 illustrates a diagram of another embodiment of the present invention submersible pump system wherein it is adapted for use with a drop-in arrangement; such as an open reservoir or an open or closed tank; and, FIG. 4 illustrates an adapter shroud for use with the present invention arrangement illustrated in FIG. 3.

DETAILED DESCRIPTION OF THE PRESENT INVENTION

Figure 1:
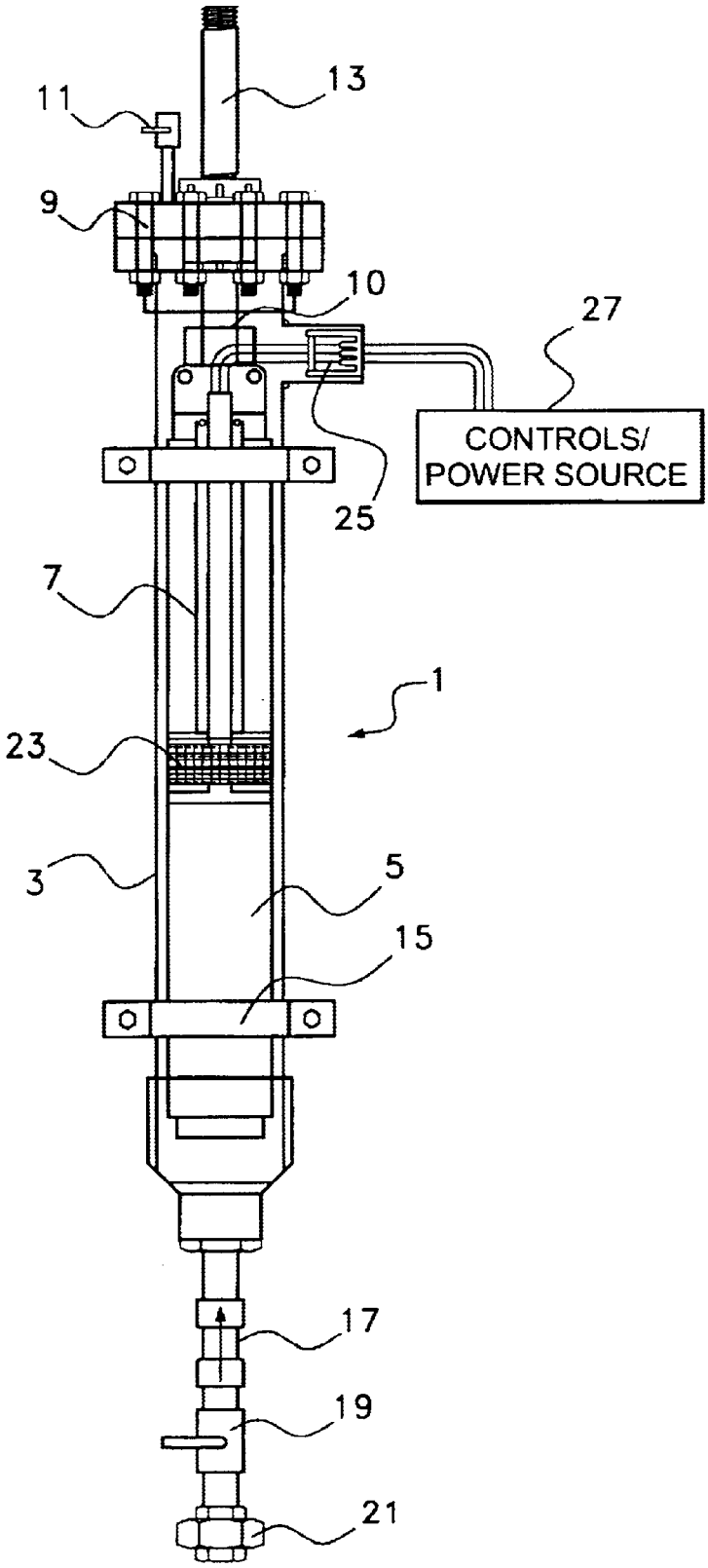
FIG. 1 illustrates a diagram of one embodiment of the present invention submersible pump system wherein it is adapted for connection to a piped water or other liquid source.

FIG. 1 illustrates a diagram of one embodiment of the present invention submersible pump system for connection to a piped liquid source. The system 1 includes a main housing 3, which is watertight and adapted to receive and contain a submersible pump therein, leaving just enough space to permit annular flow around the pump motor to permit cooling and allow liquid to be pulled into pump inlet 23. Submersible pump 7 is located in central area 5 of main housing 3, as shown and is positioned vertically therein. There is a suction flow inlet 21 for functional connection to a liquid source, e.g., such as processed liquid food, water or the like. Here, a pipe union is included at inlet 21, but any available connection could be used. There is also a shut off valve 19 for shutting the suction inlet source from the main housing 3, but this could be further upstream or excluded. Downstream from inlet 21 (and shut off valve 19) is one-way valve 17, which permits flow into main housing 3, but prevents flow in the opposing direction (from the main housing 3 to inlet 21). The submersible pump 7 has its own, submersed inlet 23 that is open to the central area 5 of the housing. The submersible pump 7 also has a pump outlet 10 that is directly connected to liquid flow outlet 13. Pump outlet 10 is isolated from and not open to the incoming liquid until after it passes through the pump.

In this FIG. 1 embodiment, the top 9 of main housing 3 is a wide flange with bolts for easy access to the submersible pump 7 for insertion removal and repair. There is also an air release (bleeder) valve 11 to remove air from main housing 3 when it is being filled with liquid, but able to shut off so as not to draw air in when the pump is running. There is a watertight bushing 25 that seals the control wiring that extends from submersible pump 7 to external controls and power source 27. By this arrangement, advantages of the present invention set forth above are achieved.

Figure 2:
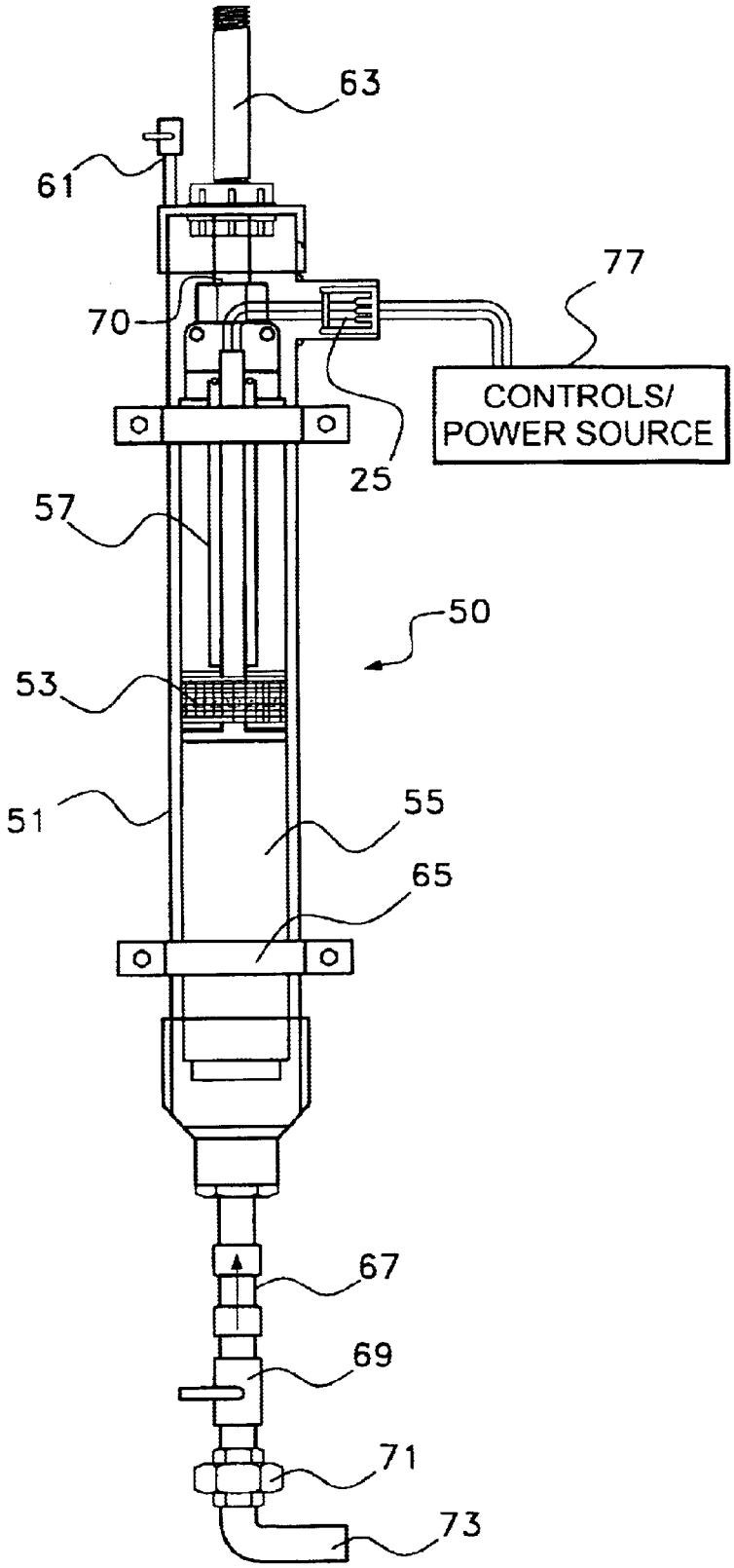
FIG. 2 illustrates a diagram of another embodiment of the present invention submersible pump system wherein it is adapted for connection to a piped water or other liquid source.

FIG. 2 illustrates a diagram of another embodiment of the present invention submersible pump system wherein it is adapted for connection to a piped water or other liquid source. The present invention system 50 includes a watertight main housing 51, which is adapted to receive and contain a submersible pump 57. This is located in central area 55 of main housing 51. While it is positioned vertically therein, submersible pump 55 could be atilt as could be main housing 55 itself, without exceeding the scope of the present invention. Parameters for preferred angle positions are discussed above. There is a suction inlet 71, which includes a union which is functionally connected to a liquid source 73, by piping. There is a shut off valve 69 for shutting the liquid inlet source from the main housing 51. Downstream from inlet 71 and shut off valve 79, is one-way valve 67, which operates in a fashion similar to the one-way valve 17 described in conjunction with FIG. 1 above.

The submersible pump 57 has its submersed inlet 53 that is open to the liquid being drawn in. The submersible pump 57 also has a pump outlet 70 that is directly connected to liquid flow outlet 107. Pump outlet 70 is isolated from and not open to the incoming liquid until after it passes through the pump. There is an air release (bleeder) valve 61 to remove air from main housing 51 when filling with liquid, but able to be shut off so as not to be draw air in when the pump is running. There are watertight bushings 25 that seal the control wiring that extend from the submersible pump 57 to external controls and power source 77.

FIG. 3 illustrates a diagram of another embodiment of the present invention submersible pump system wherein it is adapted for use with a drop-in arrangement, such as an open reservoir for an open or closed tank on any other body of liquid. The present invention system 100, shown in FIG. 3 includes a watertight main housing 101, which contains submersible pump 109 located in central area 103 of main housing 101. There is a liquid flow inlet 117, which includes an open grid orifice for pulling liquid from a pool or reservoir, rather than from a pipe or other fixed or attached source. In other words, this embodiment is particularly useful for open liquid sources rather than closed, connected sources, e.g. Downstream from inlet 117, is one-way valve 115, which operates in a fashion similar to the one-way valve 17 described in conjunction with FIG. 1 above.

The submersible pump 109 has its submersed inlet 105 that is open to the central area 5 of the housing. The submersible pump 109 also has a pump outlet 110 that is directly connected to liquid flow outlet 107. Pump outlet 110 is isolated from and not open to the incoming liquid until after it passes through the pump. There is an air release (bleeder) valve 113 to remove air from main housing 100 when filling with liquid, but able to shut off so as to draw air in when the pump is running. There are watertight bushings that seal the control wiring that extends from the submersible pump 109 to external controls and power source 120. This could include an optional timer so as to have the pump turn on and off at predetermined time intervals. Also, a float could be maintained at or near the bottom of the reservoir being pumped and an automatic float switch 122 could be utilized to turn the pump on and off on demand, i.e., as the reservoir filled, the pump would turn on, and when emptied or close to emptied, the pump would turn off.

FIG. 4 illustrates an adapter shroud for use with present invention arrangement illustrated in FIG. 3. Referring to both FIGS. 3 and 4, with FIG. 4 showing in detail lower portion of present invention system 100 shown in FIG. 3, for structural support, a base 123 and upright supports 121 are used to hold the system 100 in a vertical, free standing, secure position during use. In order to permit pumping of very shallow containers on to allow other containers to be nearly completely pumped out, there is a suction adapter shroud 125 adapted to fit into supports 121.

Obviously, numerous modifications and variations of the present invention are possible in light of the above teachings. It is therefore understood that within the scope of the appended claims, the invention may be practiced otherwise than as specifically described herein.

What is claimed is:

1. A liquid pumping system for providing a self-contained watertight submersible pump, which comprises:

(a) a main housing, said main housing being watertight and adapted to contain a submersible pump therein;

(b) a liquid suction inlet for functional connection to a liquid source, said liquid suction inlet being functionally connected to said housing and having at least one suction inlet opening thereon;

(c) an in-line one way check valve functionally connected to said main housing and located downstream from said liquid suction inlet, said one way check valve adapted to permit liquid to flow from said liquid suction inlet to said main housing and adapted to prevent liquid from flowing from said main housing to said liquid suction inlet;

(d) a submersible pump contained within said main housing downstream from (said one way check valve, said submersible pump having electrical wiring and control wiring connected thereto and extending out of said main housing with a watertight seal, said submersible pump having a submersible pump inlet located within said main housing and adapted to pump liquid from said main housing;

(e) a liquid flow outlet connected to said submersible pump and extending out through said main housing for liquid distribution therefrom;

wherein said main housing is adapted to pull liquid in through said liquid suction inlet, maintain a predetermined liquid level within said main housing above said submersible pump inlet, even when said submersible pump is pumping from very shallow external liquid sources whereby said submersible pump is always surrounded by liquid immediately before, during and immediately after its operation, said main housing further providing liquid to said submersible pump inlet, and wherein said liquid flow outlet provides liquid flow from said submersible pump to a location exterior of said main housing directly from said submersible pump, and, further wherein said main housing and the components contained therein are arranged in a substantially vertical manner with said one way check valve located above said liquid suction inlet, said submersible pump located above said one way check valve, and said liquid suction outlet located above said submersible pump, and, further wherein said system further includes a support base located below said liquid suction inlet and at least one vertical support member connected from said base to said main housing.

2. The liquid pumping system of claim 1 wherein said main housing includes an air bleeder valve to permit air to bleed from said main housing when it is being filled with liquid, but be able to shut off so as not to draw air in when the pump is running.

3. The liquid pumping system of claim 1 wherein said main housing contains at least one support member connected thereto for attachment of said main housing to a vertical fixed structure.

4. The liquid pumping system of claim 1 wherein said main housing includes a removable watertight top of sufficient size to permit removal and insertion of said submersible pump.

5. The liquid pumping system of claim 4 wherein said liquid suction inlet is connected to an upstream couplet for connection to a water supply pipe.

6. The liquid pumping system of claim 5 wherein there is a shut off valve located between said liquid suction inlet and said one way check valve.

7. The liquid pumping system of claim 1 which further includes at least one control mechanism for controlling said submersible pump that is located downstream from said main housing.

8. The liquid pumping system of claim 7 wherein said control mechanism is a pressure switch.

9. The liquid pumping system of claim 1 wherein said system further includes an adapter shroud located around said liquid suction inlet and connected to at least one of said support base and said at least one vertical support member.

10. A liquid pumping system for providing a self-contained watertight submersible pump, which comprises:

(a) a main housing, said main housing being watertight and adapted to contain a submersible pump therein;

(b) a liquid suction inlet for functional connection to a liquid source, said liquid suction inlet being functionally connected to said housing and having at least one suction inlet opening thereon;

(c) a one way check valve functionally connected to said main housing and located downstream from said liquid suction inlet, said one way check valve adapted to permit liquid to flow from said liquid suction inlet to said main housing and adapted to prevent liquid from flowing from said main housing to said liquid suction inlet;

(d) a submersible pump contained within said main housing downstream from said one way check valve, said submersible pump having electrical power wiring and control wiring connected thereto and extending out of said main housing with a watertight seal, said submersible pump having a submersible pump inlet located within said main housing and adapted to pump liquid from said main housing;

(e) a liquid flow outlet connected to said submersible pump and extending out through said main housing for liquid distribution therefrom;

wherein said main housing is adapted to pull liquid intake through said liquid suction inlet, maintain a predetermined liquid level within said main housing above said submersible pump inlet, even when said submersible pump is pumping from very shallow external liquid sources whereby said submersible pump is always surrounded by liquid immediately before, during and immediately after its operation, said main housing further providing liquid to said submersible pump inlet, and wherein said liquid flow outlet provides liquid flow from said submersible pump to a location exterior of said main housing directly from said submersible pump, wherein said system further includes a liquid level-based automatic control located outside of said main housing and connected to said control wiring of said submersible pump, and adapted to turn on said submersible pump when a predetermined exterior liquid level is attained and to turn off said submersible pump when said exterior liquid level falls below a predetermined level, wherein said control is a level sensor located at said liquid suction inlet, further wherein said main housing and the components contained therein are arranged in a substantially vertical manner with said one way check valve located above said liquid suction inlet, said submersible pump located above said one way check valve, and said liquid suction outlet located above said submersible pump, and, finally wherein said system further includes a support base located below said liquid section inlet and at least one vertical member connected from said base to said main housing.

11. The liquid pumping system of claim 10 wherein said main housing includes an air bleeder valve to permit air to bleed from said main housing when it is being filled with liquid, but be able to shut off so as not to draw air in when the pump is running.

12. The liquid pumping system of claim 10 wherein said main housing contains at least one support member connected thereto for attachment of said main housing to a fixed structure.

13. The liquid pumping system of claim 10 wherein said system further includes an adapter shroud located around said liquid suction inlet and connected to at least one of said main housing and said liquid suction inlet.

14. The liquid pumping system of claim 10 wherein said system further includes a support base located below said liquid suction inlet and at least one vertical support member connected from said base to said main housing.

15. The liquid pumping system of claim 14 wherein said system further includes an adapter shroud located around said liquid suction inlet and connected to at least one of said support base and said at least one vertical support member.

16. The liquid pumping system of claim 10 wherein said main housing includes a removable watertight top of sufficient size to permit removal and insertion of said submersible pump.

* * * * *